US008602083B2

(12) United States Patent
Svensson et al.

(10) Patent No.: US 8,602,083 B2
(45) Date of Patent: Dec. 10, 2013

(54) METHOD OF COMPOSITE CASTING OF A ONE-PIECE CAST TOOL

(75) Inventors: Christer Svensson, Karlshamn (SE); Tomas Nilsson, Katrineholm (SE)

(73) Assignee: Verktygs Allians i Hässleholm AB, Hässleholm (SE)

( * ) Notice: Subject to any disclaimer, the term of this patent is extended or adjusted under 35 U.S.C. 154(b) by 0 days.

(21) Appl. No.: 12/920,905

(22) PCT Filed: Mar. 5, 2009

(86) PCT No.: PCT/SE2009/000126

§ 371 (c)(1),
(2), (4) Date: Nov. 15, 2010

(87) PCT Pub. No.: WO2009/110834

PCT Pub. Date: Sep. 11, 2009

(65) Prior Publication Data

US 2011/0123828 A1 May 26, 2011

(30) Foreign Application Priority Data

Mar. 6, 2008 (SE) ..... 0800524

(51) Int. Cl.
*B22D 19/06* (2006.01)
*B22D 19/16* (2006.01)

(52) U.S. Cl.
USPC ..... 164/95; 164/198

(58) Field of Classification Search
USPC ..... 164/6, 34, 45, 91, 94, 95, 98
See application file for complete search history.

(56) References Cited

FOREIGN PATENT DOCUMENTS

DE 806037 C 6/1951

OTHER PUBLICATIONS

International Search Report for corresponding International App. PCT/SE2009/000126, mailed Jul. 2, 2009.
JP3189065 A, Takagi Chuko KK, Aug. 19, 1991 (abstract).
JP 55081061 A, Rasa Kogyo KK, Jun. 18,1980 (abstract).
JP 58032543 A, Sumitomo Metal Ind. Ltd., Feb. 25, 1983 (abstract).
JP 1066061 A, Nippon Steel Corp., Mar. 13, 1989 (abstract).
JP 57025276 A, Nissan Motor Co. Ltd., Feb. 10, 1982 (abstract).

*Primary Examiner* — Kevin P Kerns
(74) *Attorney, Agent, or Firm* — WRB-IP LLP

(57) ABSTRACT

A method of one-piece casting of a tool with a working component of steel and a body of grey iron, and an interconnection zone therebetween is carried out in a single mold which is kept closed and unchanged during the casting. The steel is cast first from beneath and upwards, whereafter a pause is made. The casting of the grey iron is only carried out when the temperature of the steel in the intended interconnection zone has fallen to a temperature corresponding to the liquidus temperature of the steel minus approx. 30° to 150° C.

8 Claims, 6 Drawing Sheets

METHOD OF COMPOSITE CASTING OF A ONE-PIECE CAST TOOL

BACKGROUND AND SUMMARY

The present invention relates to a method of composite casting of a one-piece cast tool which comprises at least a first portion which comprises the working component of the tool and which is manufactured from steel, and a second portion which comprises the body component of the tool and which consists of or comprises grey iron, there being formed an interconnection zone between the steel and the grey iron.

In the production of tools for sheet metal working, for example cutting, hole making, bending or other shaping, previous practice has generally been to separately produce a tool body by casting of grey iron. The cast tool body has often required heat treatment and thereafter machining in order to create the requisite seats, holes for guide stub shafts, bolt holes etc., so that securing is made possible of working components, for example steel cutters, for carrying out the working operations proper for which the tool is intended. These working components have been manufactured from steel and the point of departure has often been bar material, the working components having been machined to the correct configuration, provided with apertures for guide stub shafts, fixing bolts and the like. This has been often followed by heat treatment, whereafter additional machining, for example grinding, has been carried out.

To produce a tool in the above-outlined manner is extremely time-consuming and expensive, and is often therefore determinative of the time consumption that is required for the new production of different sheet metal products.

WO 03/041895 discloses a one-piece cast composite tool which consists of two different material qualities, as well as a method of manufacturing such a tool.

According to the prior art technology, two different material qualities are cast in one and the same mould, steel being cast for forming working components in the tool, while grey iron has been cast for producing the tool body proper. Between the two material qualities, an interconnection zone is formed where, to some degree, mixing of the two material qualities may take place. The prior art technology suffers from numerous problems since it does not offer any possibility of positioning the interconnection zone in the tool in such a manner that the mechanical strength of the interconnection zone can be optimised.

In order for the interconnection zone to achieve the requisite quality, careful and accurate control is required of the temperature of the material which is cast first, before casting can take place of the material which is cast last. The prior art technology offers no such possibilities.

Finally, the prior art technology otters no possibility of orienting, in a suitable manner, the interconnection zone in a mould for producing the tool.

It is desirable to design the method intimated by way of introduction so that it obviates the drawbacks inherent in the prior art technology. In particular, it is desirable to design the method according to the invention so that the position of the interconnection zone may be optimised in view of mechanical strength aspects. It is also desirable to design the method according to the invention so that a superior control of the temperature conditions in and at the interconnection zone is created on casting of the last cast material. It is also desirable to design the method according to the invention in such a manner that the orientation of the interconnection zone in a mould may readily be controlled.

According to an aspect of the present invention, a method is characterised in that the casting process is carried out in a single mould which is kept unchanged and closed throughout the entire casting process, that the steel is cast first and in a direction from beneath and upwards, that after the casting of the steel a pause is made, and that the casting of the grey iron is carried out only when the temperature of the steel in the intended interconnection zone has fallen to a first temperature corresponding to the liquidus temperature of the steel minus approx. 30° to 150° C.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
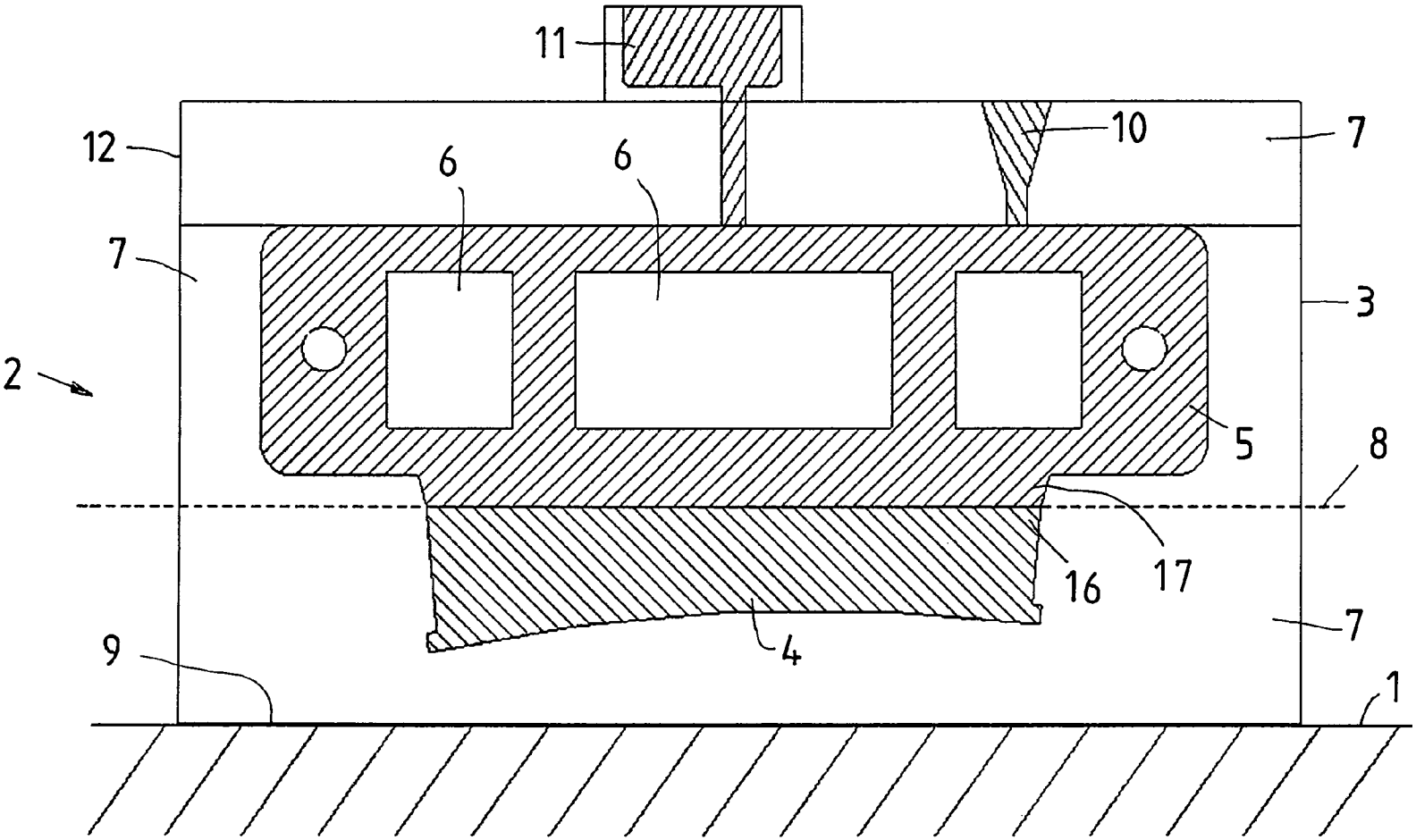
FIG. 1 is a schematic cross section through a mould for reducing the method according to the present invention into practice.

Referring to the Drawings, in FIG. 1, reference numeral 1 relates to a substrate on which rests a mould 2 for reducing the present invention into practice. The substrate 1 is preferably a horizontal floor. If no such floor is available, some equalisation platform or the like must be placed on the substrate so that its upper surface will be horizontal and the mould thus rests on a horizontal substrate.

The moulding consists of or comprises a moulding box or flask 3, which encloses in itself a first model section 4 and a second model section 5. In such instance, the first model section 4 is designed for casting of the working component of the tool by casting of steel. It should be emphasised already at this stage that the tool may very well have more than one working component and thus the mould may have several first model sections 4.

Above the first model section 4, there is disposed a second model section 5 which is intended for the casting of grey iron, so that a tool body is formed. The second model section may, in the conventional manner, be provided with mould cores so that cavities 6 are formed in the tool body cast from grey iron. In addition, the mould box 3 is, in the conventional manner, filled with foundry or moulding sand 7 which has tamped, packed and set.

Both of the model sections 4 and 5 have a planar contact surface where they are in contact with one another, or where they are united. This contact surface 8 is the desired position of the interconnection zone which is formed in the interface region between the steel which is cast in the first model section 4 and the grey iron which is cast in the second model section 5. The contact surface 8 is parallel with the lower edge 9 of the moulding box 3 so that the contact surface 8 will be horizontal when the moulding box rests on a horizontal substrate.

In the production of the mould according to FIG. 1, an upper portion 12 of the moulding box is first removed and the moulding box 3 is placed on a planar, horizontal substrate with its upper edge turned to face downwards. Thereafter, the total model, which hence consists of or comprises two or more first sections 4 and one second section 5 is placed on a substrate 1 on which the upper edge of the moulding box 3 rests. This presupposes however that the contact plane 8 is parallel with the upper surface of the second model section 5. The important feature is that the contact plane 8 will be horizontal in the casting position of the mould, in the mould illustrated in FIG. 1, parallel with the lower edge 9 of the moulding box.

It may be appropriate to join together the second model section 5 with the first model section or sections 4, so that they together form a manageable unit.

Thereafter, the moulding box 3 is filled with foundry or moulding sand of suitable quality, and it should here be emphasised that this moulding sand need not be of the same quality around the second model section 5 and around the first model section or sections 4. When the moulding box 3 has been filled in this manner with moulding sand and the sand has been tamped, packed and permitted to set, the moulding box 3 is inverted to the moulding position, it being ensured that the contact plane 8 is horizontal in that the substrate on which the moulding box is placed is also horizontal. Thereafter, the upper portion 12 is placed on the moulding box 3 and the mould is completed with the ingates 10 and 11.

If the second section 5 of the model were not to have its upper side 5 (according to FIG. 1) parallel with the contact plane 8, the second model section 5 must be chocked up to a correct inclination which compensates for the non-parallelism between the contact plane 8 and the upper surface, so that thereby, in the finished mould 2, the contact plane 8 will always be horizontal when the moulding box 3 is on a horizontal substrate.

In FIG. 1, reference numeral 10 relates, as was intimated above, to an ingate for the steel which is to be cast in the first model section 4. While not being apparent from FIG. 1, the ingate system that is employed for casting of the steel is formed in such a manner that it at least partly extends in under the first model section 4 and connects to it in order to give a casting direction for the steel from beneath and upwards towards the contact surface 8, which represents the desired position of the interconnection zone which is to be formed between the two different material qualities.

The design of the ingate system for the grey iron may be made in a conventional manner. In order to close the mould box 3 upwardly and accommodate parts of the ingate systems, there is provided an upper portion 12 above the moulding box 3 which includes moulding or foundry sand 7.

Both of the model sections 4 and 5, which are included in the total mould model in FIG. 1, are destructible models on casting, for example produced from expanded polystyrene. In a conventional manner they are also provided with blacking to improve the surface finish on the cast material.

Figure 2:
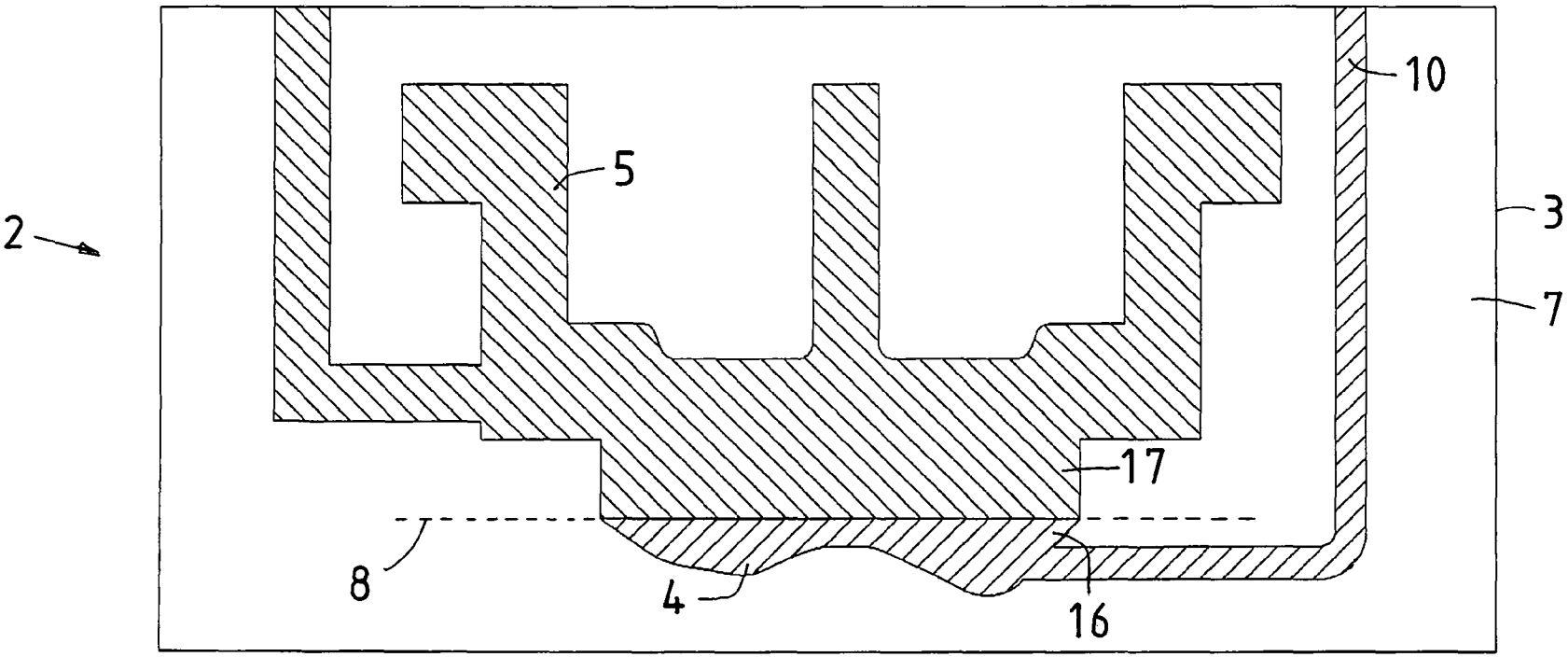
FIG. 2 is a schematic cross section of a modified embodiment of a mould for reducing the method according to the present invention into practice.

FIG. 2 shows an alternative embodiment of a mould 2 for reducing the present invention into practice. The reference numerals in this Figure correspond to the reference numerals in FIG. 1, but it will be clearly apparent that both of the model sections 4 and 5 have completely different appearances. Also in the embodiment according to FIG. 2, there may occur a plurality of first model sections 4, which are connected either directly to the ingate system 10 or indirectly via communications between the different first model sections.

It will be apparent from both FIG. 1 and FIG. 2 that, on casting of the steel in the first model section or sections 4, these will be destroyed by the steel melt, since the model sections are produced from expanded polystyrene. However, this also applies to a part of the second model section 5, at least in the area straight above the first model section 4. This implies that, after the casting of the steel, those portions of the foundry sand that are exposed downwards towards the first model section or sections 4 will be exposed to an extremely powerful thermal radiation which possibly could break down the binder in the foundry sand. For this reason, the second model section 5, at least on those parts which are exposed to this thermal radiation, are provided with extra protection in the form or one or more extra layers of blacking.

Regardless of whether the mould 2 has the appearance as illustrated in FIG. 1 or FIG. 2, the steel is always cast first at a temperature of the order of magnitude or 1550° C. Once the steel casting has been completed and the upper surface of the steel has reached the level of the contact surface 8, a pause is made in the casting process, so that the cast steel is permitted to cool. In such instance, it has been ensured that the steel cools last in the region of the contact surface or plane 8 in that the first model section has been given a form which entails that, to some degree, it tapers downwards (according to FIGS. 1 and 2) in a direction away from the contact surface or plane 8. As a result, a directed cooling will be obtained, where the cooling first takes place in the lower parts of the first model section 4 and last in the region at the contact surface or plane 8.

At the contact surface 8, parts of the first and the second model sections 4 and 5, respectively, have been given uniform thickness throughout their entire length (the length in the direction from left to right in FIGS. 1 and 2). The uniform thickness implies that the temperature distribution throughout the entire contact surface 8 where the model sections meet one another, will relatively uniform, which is an important precondition for good quality in the interconnection zone. In actual fact, it is the case that, by computer simulation, the parts 16, 17 of the two model sections, lying in the proximity of the contact surface, are formed in such a manner that the steel cast in the lower model section will have as uniform a temperature distribution at the contact surface 8 as is humanly possible to achieve. In the same manner, by means of a computer simulation, a calculation is made of the time that is needed for achieving a temperature in the steel cast in the first model section 4 at the contact surface 8, a first temperature corresponding to the liquidus temperature of the selected steel quality minus approx. 30° to 150° C., often in the region of 1440° to 1320° C.

This pause or stay time in the casting process may amount to one or a few minutes, but it may also be as long as between 15 and 20 minutes, depending overall on the size of the first model section or sections 4.

The casting of the grey iron is carried out when the computed pause or stay time has elapsed at a second temperature, which corresponds to the liquidus temperature of the grey iron plus approx. 100° to 150° C., often approx. 1320° C.

At the interconnection zone, if the casting of the grey iron takes place at an elevated first temperature, i.e. at or above the upper end of the exemplified temperature range of approx. 1440° to 1320° C., a certain intermixing of the two materials may occur at the same time as a diffusion process occurs, where parts of the one material migrate into the other and vice versa. If, on the other hand, the casting takes place at a low first temperature, i.e. at or below the lower end of the exemplified temperature range, a diffusion process still occurs, which implies that the interconnection zone will also have a certain intermixing of the two materials, and still a thickness of at least a millimeter or so, but preferably slightly more, possibly up to 2.5-3.0 mm.

In practical strength trials which have been conducted, no breakage, either in tensile or bending tests, has occurred in the interconnection zone proper, but always occurred in the grey iron.

As was mentioned above, the contact surface 8, i.e. the theoretical position of the interconnection zone in the vertical direction, is horizontal. Since the interconnection zone is defined by the upper, free surface of the steel melt, it will readily be perceived that this will planar and also horizontal.

Figure 3:
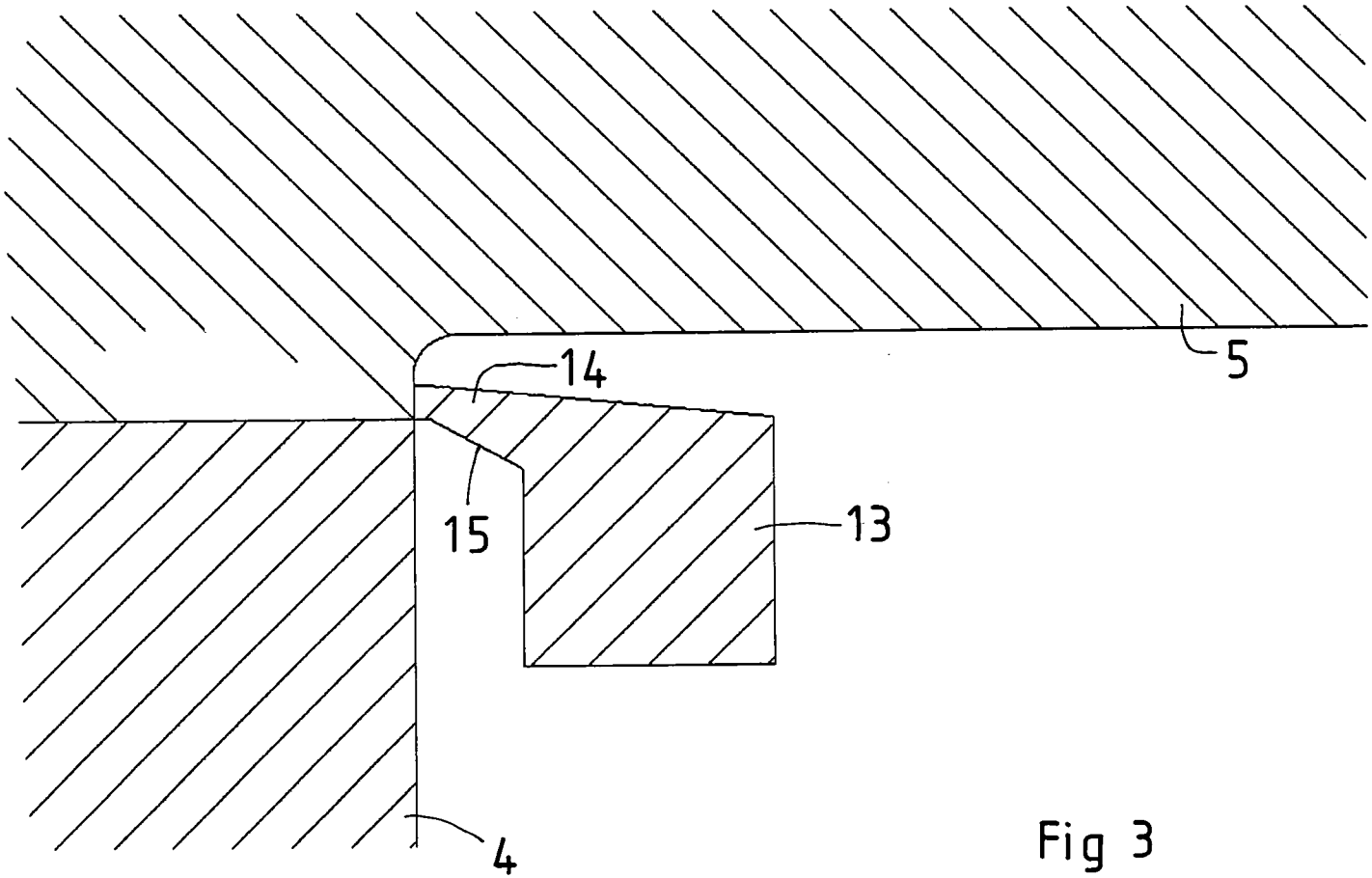
FIG. 3 is a detailed section through a mould for applying the method according to the present invention.

There are certain problems in accurately computing the quantity of steel melt which is to be cast in the mould 2. For this reason, the mould has been provided with one or more accommodation spaces 13 to which any possible surplus of steel will be permitted to run so that, thereby, the level of the cast steel will always be at the contact surface 8. FIG. 3 shows in cross section a detail through a mould, where such an accommodation space 13 is provided. The accommodation space 13 is connected via a duct 14 to the mould cavity of the mould in the region of the contact surface 8. The duct 14 has a lower wall 15 which, in the mould cavity, discharges on the level of the contact surface 8. The cross-sectional area of the duct 14 is so large that it exceeds the total cross sectional area of the ingate system for steel, preferably by at least a factor of 1.5. It will also be apparent from FIG. 3 that the lower duct wall 15 slants from the contact surface 8 in a downward direction towards the accommodation space 13.

Depending on the form, size and the number of the first model sections 4, a plurality of different accommodation spaces 13 may be employed. In such instance, one accommodation space may directly or indirectly, via ducts, serve two or more first model sections 4, but the reverse is also possible.

In order to give the interconnection zone the correct formation, i.e. uniform width throughout its entire extent, the first model section 4 has an upper region 16 which forms a uniformly thick wall or projection, which is directed in the vertical direction in the mould 2 and which extends up towards the second model section 5. Correspondingly, the second model section 5 has a uniformly thick wall 17 or projection which extends downwards in a direction towards the first model section 4. The interconnection zone is placed between both of these wall portions 16 and 17 displaying substantially constant cross-sectional area in the region of the interconnection zone, i.e. the contact surface 8. Further, the lower end surface (in FIGS. 1 and 2) of the upper wall 17 abuts against the upper end surface of the lower wall 16 and further these end surfaces coincide substantially as regards size and configuration.

Figure 4:
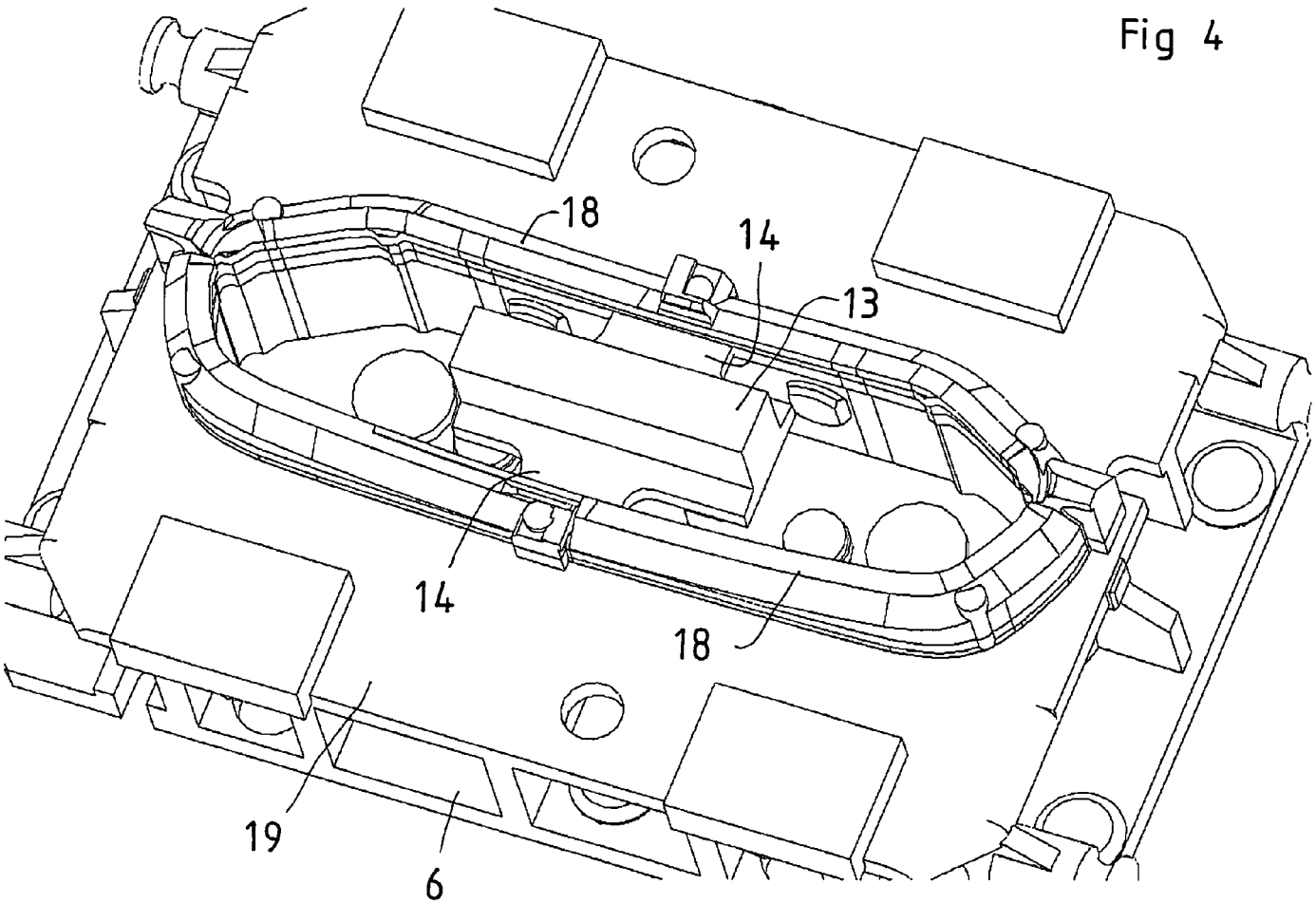
FIG. 4 shows a tool cast according to the method according to the present invention, seen in perspective obliquely from beneath, compared with the position during the casting process.

FIG. 4 shows (in a position inverted in relation to the position during casting) in perspective a tool cast according to the invention, and it will be apparent that this has a steel portion 18 which is cast in the first model section 4, and a grey iron portion 19 which is cast in the second model section 5. The Figure also shows an accommodation space 13 and two ducts 14, by means of which it is connected to the first model section 4 (the steel portion 18).

That steel which may possibly arrive in the accommodation space or spaces 13 disposed in the mould is removed gradually, according as the casting of the complete tool proceeds.

Figure 5:
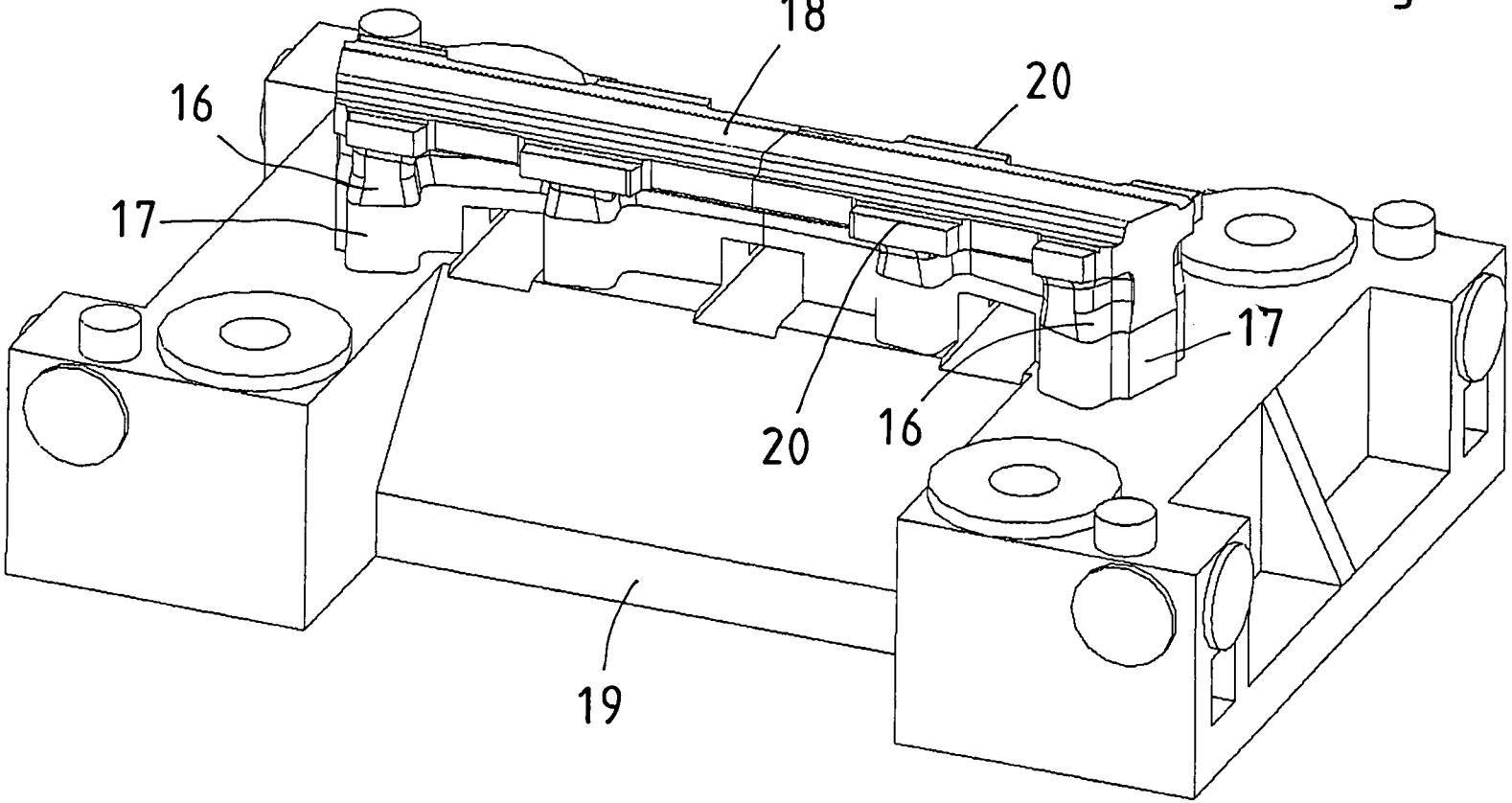
FIG. 5 is an alternative view corresponding to that of FIG. 4.

FIG. 5 shows (in a position inverted in relation to the position during casting) in perspective a tool cast according to the present invention. It will be clearly apparent that the grey iron portion 19 has a wall 17 upwardly directed towards the steel portion 18, the wall being of uniform thickness throughout its entire extent. Correspondingly, it will be apparent that the steel portion 18 has a wall 16 directed towards the grey iron portion 19 and having the same size and extent as the wall 17.

Figure 6:
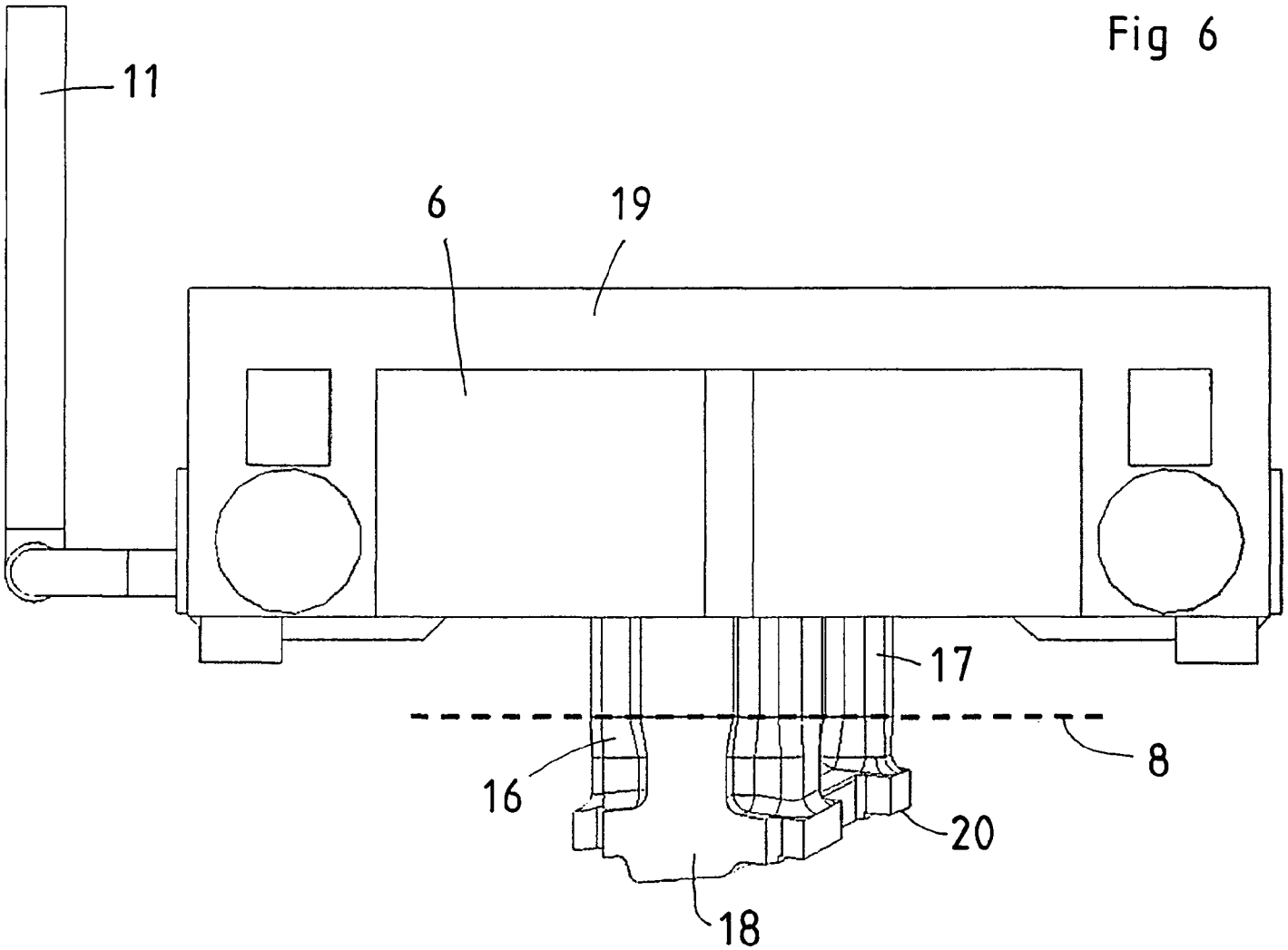
FIG. 6 is a top plan view of a tool cast according to the present invention.

FIG. 6 shows a further embodiment of a composite tool cast according to the present invention, which is shown in the same position as it has on casting in the mould. It will be apparent that the contact surface 8, i.e. the interconnection zone in the finished tool, is horizontal. It will further be clearly apparent from the Figure that the grey iron portion 19 of the tool has a downwardly directed wall 17 which has its counterpart in an upwardly directed wall 16 on the steel portion 18 of the tool. Also in this embodiment, there is a number of cutting edges 20 on the steel portion.

As was mentioned above, the steel is cast from beneath and upwards as first component before the grey iron is cast. Since the model 4, 5 is produced from expanded polystyrene, this will be destroyed, be vaporised and combust already during the casting of the steel. This implies quite a voluminous development of gas which would have as a consequence an uncontrolled and rapid gas outflow and combustion of the gases in the ingate 11 to the grey iron portion. In order to realise a better controlled casting process for the steel, but above all for reasons of working environment health, the ingate 11 to the grey iron is kept blocked while the steel is cast, so that the gases thus generated are forced to depart via other routes, for example via a ventilation system or quite simply through the foundry sand in the moulding box.

What is claimed is:

1. A method of composite casting of a one-piece cast tool which comprises at least one first portion which comprises a working component of the tool and which is manufactured from steel, and a second portion which comprises a body component of the tool and which comprises grey iron, there being formed an interconnection zone between the steel and the grey iron, comprising carrying out the casting process in a single mold which is kept unchanged and closed throughout an entire casting process, casting the steel in a direction from beneath and upwards, after casting of the steel, pausing for a period of time, depending upon on a quantity of and shape of the at least one first portion of the tool, so that a first temperature in the steel at contact surface of the steel is substantially uniform and corresponds to the liquidus temperature minus approximately 30°-150° C., and casting the grey iron onto the contact surface of the steel to form the interconnection zone after the steel is at the liquidus temperature minus approximately 30°-150° C.

2. The method as claimed in claim 1, comprising optimizing the formation of the first portion in a computer simulation, given that that part of the steel which is to cool last is to be located at the interconnection zone.

3. The method as claimed in claim 1, casting the grey iron at a second temperature corresponding to the liquidus temperature of the grey iron plus 100° to 150° C.

4. The method as claimed in claim 1, comprising placing the interconnection zone in a uniformly thick wall or column which, during the casting, is given a direction so that it extends in a vertical direction.

5. The method as claimed in claim 1, comprising keeping a vertical position of the interconnection zone within a predetermined interval by drawing or running off of surplus of steel at a level of the interconnection zone and permitting it to flow to an accommodation space.

6. The method as claimed in claim 1, comprising casting the steel in an ingate system which, in a position of use of the mold, is at least partly disposed under the first portion.

7. The method as claimed in claim 1, wherein, in producing the mold, the contemplated interconnection zone is placed substantially parallel with an underside of the mold.

8. The method as claimed in claim 7, wherein the mold is placed on a substantially horizontal substrate.

* * * * *